US005903924A

United States Patent [19]

Garbit

[11] Patent Number: 5,903,924

[45] Date of Patent: May 18, 1999

[54] BALL-SCARF

[76] Inventor: Bernard Garbit, 42, rue Bancel, F-69007, Lyon, France

[21] Appl. No.: 08/860,171

[22] PCT Filed: Dec. 13, 1995

[86] PCT No.: PCT/FR95/01658

§ 371 Date: Aug. 11, 1997

§ 102(e) Date: Aug. 11, 1997

[87] PCT Pub. No.: WO96/18316

PCT Pub. Date: Jun. 20, 1996

[30] Foreign Application Priority Data

Dec. 15, 1994 [FR] France ..... 94 15358

[51] Int. Cl.[6] ..... A41D 23/00

[52] U.S. Cl. ..... 2/207; 446/126; 473/575; 473/596

[58] Field of Search ..... 2/207; 446/120, 446/126; 473/134, 575, 596, 615; D2/501

[56] References Cited

U.S. PATENT DOCUMENTS

| | | | |
|---|---|---|---|
| 4,593,901 | 6/1986 | Moore et al. | 473/575 |
| 4,660,831 | 4/1987 | Kralik | 273/65 E |
| 5,228,690 | 7/1993 | Rudell et al. | 473/575 |

*Primary Examiner*—Diana L. Oleksa
*Attorney, Agent, or Firm*—Oliff & Berridge, PLC

[57] ABSTRACT

The ball scarf is a scarf having a first end and a second end. At least one of the ends has an inflatable ball pocket. The inflatable ball pocket can either have an inflatable bladder inserted therein or an inflatable ball inserted therein. Once the pocket is inflated by a user, the user can swing the ball scarf around in order to cheer his favorite team at a ball game. A needle is provided in order to inflate the inflatable bladder or inflatable ball. The inflatable ball pocket is either an integral part of the scarf or can be attached by means of a zipper or other fastener.

13 Claims, 1 Drawing Sheet

BALL-SCARF

BACKGROUND OF THE INVENTION

1. Field of Invention

The present invention relates to a ball scarf. More particularly, the present invention relates to an accessory for fans of a ball game which is designed to encourage the fan's team and create a festive atmosphere.

2. Description of Related Art

Traditional scarves offer the feature of being merely dyed and printed with a bail club's colors. They have been on the market for a number of years and do not offer or represent any great interest.

FR-A-247 995 describes a scarf having a pocket at each end. The pockets are designed to accommodate the fan's hands. There is no suggestion that these pockets are inflatable.

SUMMARY OF THE INVENTION

The ball scarf is novel and original. It is used in all types of ball games in which a ball is the central element. It does not matter what type of ball game is being played or the shape of the ball being used.

In one preferred embodiment the ball scarf comprises at least one inflatable end. The end is inflated like a ball and is used to cheer the user's team.

Other aspects and salient features of the invention will be described in or apparent from the following detailed description of preferred embodiments.

BRIEF DESCRIPTION OF THE DRAWINGS

Preferred embodiments of the invention will be described in conjunction with the following drawings, in which.

DETAILED DESCRIPTION OF PREFERRED EMBODIMENTS

Figure 1:
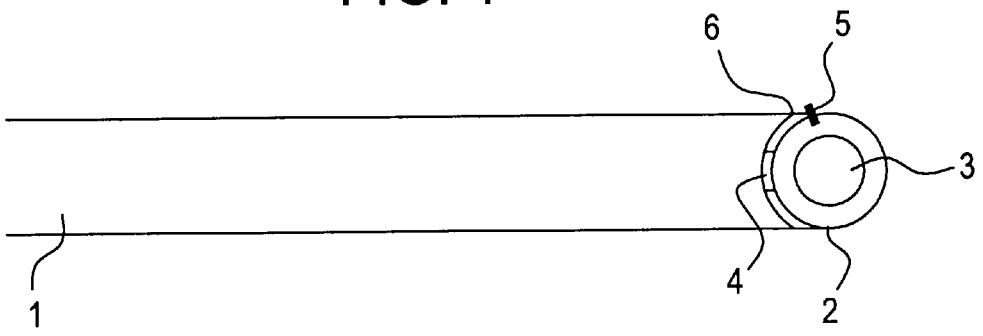
FIG. 1 shows one embodiment of the present invention before use.
Figure 2:
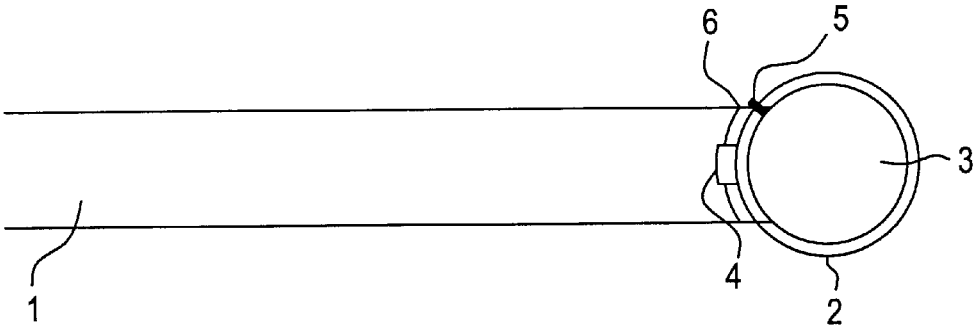
FIG. 2 shows one embodiment of the present invention with an inflated end.
Figure 3:
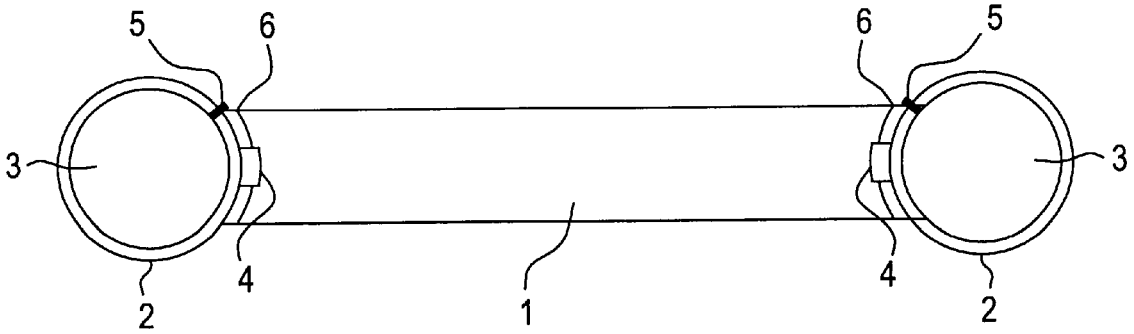
FIG. 3 shows one embodiment of the present invention with both ends inflated.

Referring to FIG. 3, in one preferred embodiment both ends of the ball scarf have a pocket made of expandable fabric. Alternatively, as seen in FIGS. 1 and 2, one end of the ball scarf has a pocket made of expandable material. In one preferred embodiment a ball is inserted into the pockets. Alternatively, an inflatable plastic pocket can be inflated with the aid of an inflation needle. The inflation needle can also inflate the ball. When a user blows into one of the pockets via the inflation needle, a life-sized ball appears. The user then waves the ball scarf to cheer his team.

The pockets can be sewn directly onto the ends of the scarf. The pockets can also be attached, for example, with zip fasteners, Velcro-type fasteners, or buttons.

Referring again to FIGS. 1 and 2, the ball scarf comprises six elements when one end is used as an inflatable pocket. These elements include a scarf 1, a ball pocket 2, a balloon or air chamber 3, a plastic envelope inflation needle or ball inflation positioning needle 5, a knob for manipulating the ball scarf 4, and an attachment point 6. The inflation needle is fitted with a valve to ensure perfect filling with air and a perfect seal for the plastic ball pockets.

Referring to FIG. 3, if both ends are used, the ball scarf comprises the ball pocket 2, inflatable envelope 3, inflation needle 5 and holding knob 4 at both ends.

In one preferred embodiment the ball scarf assembly forms a single unit. The ball pocket can be made of retractable fabric to allow it to return to its initial size after use. The ball pocket can be fireproof to prevent accidents. The ball pocket can also be made of plastic and inflated directly. In this case, after use it will deflate.

Preferred and alternative embodiments of the ball scarf have now been described in detail. It is noted, however, that this description is merely illustrative of the principles underlying the inventive concept. It is therefore contemplated that various modifications of the disclosed embodiments will, without departing from the spirit and scope of the invention, be apparent to persons of ordinary skill in the art.

I claim:

1. A ball scarf, comprising an elongated scarf having two ends, at least one of the ends of the scarf comprising an inflatable ball pocket that is shaped as a ball when inflated and a handle so that the inflatable ball pocket can be handled.

2. The ball scarf of claim 1, wherein the scarf and handle are made of materials selected from the group consisting of plastic, synthetic, wool, linen, acrylic, and polyester.

3. A ball scarf, comprising an elongated scarf having two ends, at least one of the ends of the scarf comprising an inflatable ball pocket that is shaped as a ball when inflated, wherein the inflatable ball pocket is integrally formed with the elongated scarf to form a single unit.

4. The ball scarf of claim 3, wherein the inflatable ball pocket is made from an expandable material which inflates when filled with air.

5. The ball scarf of claim 4, wherein the expandable material is an inflatable plastic envelope.

6. The ball scarf of claim 3, wherein the inflatable ball pocket receives a balloon type ball which inflates and deflates.

7. The ball scarf of claim 6, wherein an inflation needle is coupled to the balloon type ball to inflate the balloon type ball.

8. The ball scarf of claim 3, wherein the ball pocket has a shape of a ball selected from the group consisting of a football, a handball, a basketball, a rugby ball, a volleyball, a soccer ball, a tennis ball, a golf ball, a handball, a squash ball, and a bowling ball.

9. The ball scarf of claim 3, wherein an inflation needle is coupled to the inflatable ball pocket.

10. The ball scarf of claim 3, wherein the elongated scarf is made of materials selected from the group consisting of plastic, synthetic, wool, linen, acrylic, and polyester.

11. The ball scarf of claim 3, wherein the inflatable ball pocket can be detached from a remainder of the elongated scarf.

12. The ball scarf of claim 11, wherein the inflatable ball pocket is detachably connected to the remainder of the elongated scarf by a device selected from the group consisting of a zipper, a button, and a hook-and-loop-type fastener.

13. The ball scarf of claim 3, wherein the inflatable ball pocket is connected to a remainder of the elongated scarf by stitching.

* * * * *